US006349937B1

(12) United States Patent
Gämmerler et al.

(10) Patent No.: US 6,349,937 B1
(45) Date of Patent: Feb. 26, 2002

(54) SWITCHING MECHANISM

(75) Inventors: Hagen Gämmerler, Icking; Xaver Thum, Wolfratshausen; Ulrich Obermeier, Penzberg, all of (DE)

(73) Assignee: Gammerler AG, Fed Rep (DE)

( * ) Notice: Subject to any disclaimer, the term of this patent is extended or adjusted under 35 U.S.C. 154(b) by 0 days.

(21) Appl. No.: 09/349,565

(22) Filed: Jul. 8, 1999

(30) Foreign Application Priority Data

Jul. 10, 1998 (DE) ..... 198 31 062

(51) Int. Cl.[7] ..... B65H 39/10
(52) U.S. Cl. ..... 271/302; 198/369.2; 198/436
(58) Field of Search ..... 271/302, 303; 198/369.2, 436

(56) References Cited

U.S. PATENT DOCUMENTS

| | | | | |
|---|---|---|---|---|
| 2,533,184 A | * | 12/1950 | Trump | 271/303 |
| 2,883,033 A | | 4/1959 | Armstrong et al. | |
| 3,866,902 A | * | 2/1975 | Feldkamper | 271/302 |
| 4,307,800 A | * | 12/1981 | Joa | 198/369.2 |
| 4,810,153 A | * | 3/1989 | Armelin | 271/302 |
| 4,875,671 A | * | 10/1989 | Sherburne | 271/302 |
| 4,919,027 A | * | 4/1990 | Littleton | 271/302 |
| 5,108,086 A | * | 4/1992 | Seeber | 271/303 |
| 5,150,894 A | * | 9/1992 | Ricciardi | 271/302 |
| 5,158,278 A | * | 10/1992 | Auf De Mauer | 271/303 |
| 5,467,976 A | * | 11/1995 | Doucet | 271/302 |
| 5,607,146 A | * | 3/1997 | Novick et al. | 270/42 |
| 5,979,888 A | * | 11/1999 | Schlough | 270/58.21 |

FOREIGN PATENT DOCUMENTS

| | | |
|---|---|---|
| DE | 3406055 | 8/1984 |
| DE | 8806129.9 | 8/1988 |
| DE | 19530052 A1 | 4/1996 |
| DE | 19630762 | 2/1998 |
| DE | 19630762 A1 | 2/1998 |
| EP | 080625 | 6/1983 |
| JP | 60052460 | 3/1985 |
| JP | 06235855 | 8/1992 |

* cited by examiner

*Primary Examiner*—Christopher P. Ellis
*Assistant Examiner*—Khoi H. Tran
(74) *Attorney, Agent, or Firm*—Fitch, Even, Tabin & Flannery

(57) ABSTRACT

A conveying system for the conveying of a product stream of products arranged in an overlapping formation has an incoming pressing belt pair (18, 20) and at least two departing pressing belt pairs (88, 90, 88', 90). A switching mechanism 10 is provided between the incoming pressing belt pair (A) and the outgoing pressing belt pair (C).

12 Claims, 2 Drawing Sheets

SWITCHING MECHANISM

BRIEF SUMMARY OF THE INVENTION

The present invention relates to a switching mechanism for a conveying system for the conveying of a product stream of products arranged in an overlapping formation by means of a pressing belt pair and also to a conveying system equipped with such a switching mechanism.

Conveying systems for the conveying of products arranged in an overlapping formation by means of two pressing belts are basically known and enable, amongst other things, an overhead conveyance of the products. In order to direct the overlapping formation from one conveying system to a second or to a third conveying system it has hitherto been the practice to build up two complete conveying systems with a floor belt switching mechanism being inserted before them. In this way, it is possible to effect transport selectively into the one or other conveying system. A disadvantage of this is, however, the fact that half of the conveying path must be realised twice and that for this floor space must be made available which is frequently restricted in printing works.

It is the object of the present invention to provide an apparatus by which conveyor paths and space requirements can be reduced in a conveying system of the initially named kind, with it simultaneously being possible to achieve a flexible deflection of the overlapping formation onto various conveying paths and with any desired arrangement of the switching mechanism in the space.

This object is satisfied through the features of claim 1 and in particular by a switching mechanism in which a stationary base frame and also a movable pivotal element are provided to set different distributor positions. In accordance with the invention, at least one rider belt is provided which replaces one of the two press belts in the region of the switching mechanism. One deflection roller for this rider belt is secured to the base frame and a further deflection roller of this rider belt is secured to the pivotal element. Thus, in accordance with the invention, the product stream can be guided into different directions by pivoting of the movable pivotal element, with the pressure on the overlapping formation being maintained, since the first rider belt changes its position together with the pivotal element. Since one deflection roller of the first rider belt is simultaneously of stationary position, the rider belt is always pressed against the press belt which is guided through the switching mechanism.

With the switching mechanism of the invention, product streams in overlapping formation can be conveyed and deflected in any desired arrangement and, in particular, also overhead, i.e. in this case a floor area does not need to be made available. Moreover, larger conveyor paths can be spared, since it is possible to direct the overlapping stream in a fully clamped state onto different conveyor paths.

Advantageous embodiments of the invention are described in the description, in the Figures.

In accordance with a first advantageous embodiment of the invention deflection rollers for further rider belts can be secured to the pivotal element, with the rider belts preferably overlapping and being arranged in different planes. Through the provision of further rider belts, which are pivoted together with the pivotal element, a continuous pressing of the overlapping formation is ensured in every position of the switching mechanism. In particular, the arrangement of adjacent overlapping rider belts enables a continuous pressing of the overlapping formation.

A tensioning roller which is secured to a compensation element, which moves under prestress on a pivotal movement of the pivotal element, is preferably provided for the first rider belt. A compensation element of this kind can, for example, be realised in the form of a clamping lever, which always prestresses the rider belt so that it is pressed against the product stream. On pivoting of the pivotal element, the one deflection roller of the rider belt moves relative to the other deflection roller which is secured in a stationary position, so that an extension or a shortening of the active region of the rider belt along the product stream arises. With this arrangement the tensioning roller ensures that the first rider belt is always so tensioned that the desired pressing pressure always remains set with a shortening or extension of the effective region of the rider belt.

That pressing belt which is not replaced by the first rider belt can be guided, in accordance with a further embodiment of the invention, about a deflection roller of stationary position, with the radius of the deflection roller corresponding substantially to the minimum track radius of the product stream in the region of the switching mechanism. This deflection roller of stationary position thus determines the minimum track radius.

The maximum track radius can be infinite with the switching mechanism of the invention. i.e., in accordance with the invention, it is possible to achieve a straight run of the products in one conveying position of the switching mechanism.

It is advantageous when the other press belt is guided, after passing partly around the deflection roller of stationary position, around a further deflection roller with a smaller radius which is secured to the pivotal element. In this way, the press belt can also be used after passing partly around the deflection roller of stationary position as a counterpressure belt for a further rider belt. The radius ratio between the deflection roller of stationary position and the further deflection roller with a smaller radius can amount to about 3:1.

In accordance with a further advantageous embodiment a rider belt is guided around the deflection roller of stationary position and around at least one further deflection roller which is secured to the pivotal element. In this way, the support of the product stream can be further improved, with the synchronisation being ensured by the incorporation of the deflection roller of stationary position.

The first rider belt and at least one further rider belt are preferably arranged on one side of the product stream and the stationary deflection roller and a further rider belt on the other side of the product stream. In this way the product stream is reliably guided in every position of the pivotal element, with a decoupling between the input side and the output side of the switching mechanism simultaneously taking place. If, in addition, the rider belts have a product thickness adaptation at one side, then product streams of different thickness can be conveyed through the switching mechanism without problem without a new setting having to be effected.

It is particularly advantageous when the pivotal element is pivotal about 90°. In this case it is possible to feed in a straight line from an incoming pressing belt pair to a departing pressing belt pair, or to bring about a 90° deflection from the incoming pressing belt pair. At the same time all intermediate positions are naturally also possible in which the overlapping formation can be transferred to further departing pressing belt pairs. For the sake of completeness it should be noted that the terms arriving pressing belt pair and departing pressing belt pair have only been selected for the sake of better description, naturally it is also possible to operate the switching mechanism of the invention in every conveying direction.

It is particularly advantageous designwise when the pivot axis of the pivotal element and the axis of rotation of the stationary deflection roller extend coaxially.

In accordance with a further aspect of the present invention the latter provides a conveying system for the conveying of a product stream of products arranged in an overlapping formation, wherein at least one arriving pressing belt pair and at least two departing pressing belt pairs are provided. A switching mechanism is provided between the arriving and the departing pressing belt pairs and can preferably be formed as described above, whereby the product stream can be selectively directed onto one of the departing pressing belt pairs.

BRIEF DESCRIPTION OF THE SEVERAL VIEWS OF THE DRAWINGS

The present invention will be described in the following purely be way of example with reference to an advantageous embodiment and to the accompanying drawings in which are shown:

FIG. 1 shows a side view of a switching mechanism 10 which is incorporated in a conveying system for the conveyance of a product stream of products arranged in an overlapping formation. With this conveying system the overlapping formation is conveyed by means of a pressing belt pair with the individual products of the overlapping formation being clamped between the two press belts of the pressing belt pair.

In FIG. 1 an arriving pressing belt pair A can be recognised which brings in the product stream, with the switching mechanism 10 directing the product stream in the illustrated position to a departing or outgoing pressing belt pair B. For the sake of simplified representation, no further departing pressing belt pair is shown in FIG. 1. It will, however, be understood that for a switching function at least one further pressing belt pair must be provided. By way of example, a further departing pressing belt pair can be provided as a straight-line extension of the arriving pressing belt pair A. In this case this departing pressing belt pair would extend vertically downwardly in FIG. 1.

Figure 1:
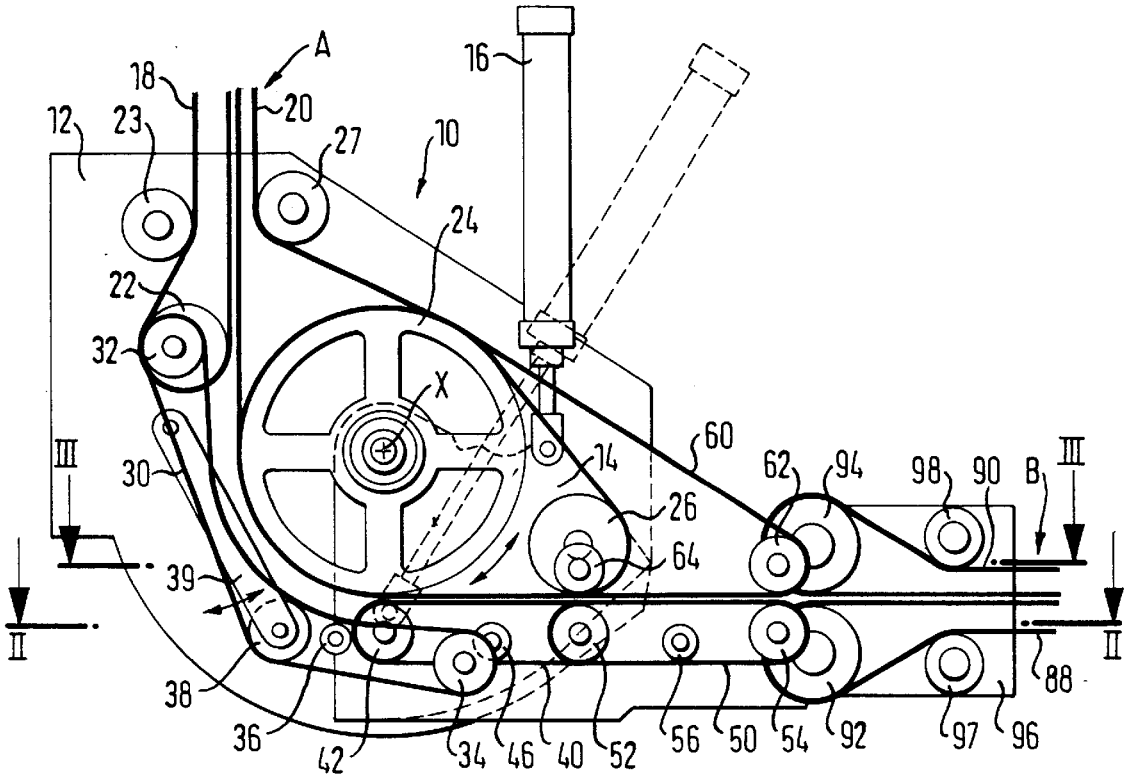
FIG. 1 a side view of a conveying system comprising a switching mechanism in accordance with the invention.

The switching mechanism 10 has a stationary base frame 12 in the form of an installation plate on which a movable pivotal element 14 in the form of the sector-like plate is secured. The pivotal element 14 can be pivoted about a pivot axis X which extends at right angles to the base frame 12. The pivotal element 14 and can be pivoted via a positioning cylinder 16 from the illustrated position through about 90° in the clockwise sense, with the positioning cylinder 16 then adopting the position shown in broken lines.

The arriving pressing belt pair A has a first press belt 18 and a second press belt 20, with the (non-illustrated) product stream, i.e. the overlapping formation, being guided pressed between the respective inner runs of the two press belts 18, 20. In the region of the switching mechanism 10, the first press belt 18 is deflected and returned at a deflection roller 22, with the returned run being deflected over a further outwardly disposed deflection roller 23 and subsequently leaving the switching mechanism 10 again.

The inner run of the second press belt 20 is guided in the region of the switching mechanism 10 around a stationary deflection roller 24, i.e. a rotatable but non-pivotally disposed deflection roller 24 of large diameter, which is surrounded by the second press belt 20 over a wrapping angle of about 90° when the switching mechanism 10 is located in the position illustrated in FIG. 1. Following this, the inner run of the second press belt 20 is deflected through about 90° from the vertical into the horizontal (in FIG. 1) with the following run (the horizontal run in FIG. 1) being ensured by a further deflection roller 26 which is secured to the pivotal element 14. The second press belt 20 subsequently wraps partly around the stationary deflection roller 24 again and is then deflected by a further deflection roller 27, which is secured to the base frame 12. After contact against this deflection roller 27 the second press belt 20 leaves the switching mechanism 10.

A total of 4 rider belts 30, 40, 50 and 60 are provided at the switching mechanism 10 for a transport of the overlapping formation through the switching mechanism, with the rider belts 30, 40 and 50 being located on one side of the overlapping formation and the rider belt 60 on the other side. For the sake of a better representation the first rider belt 30 is shown somewhat spaced from the press belt 20 in FIG. 1. In reality, it is, however, pressed against the press belt 20 as will be described in the following.

The first rider belt 30 follows the first press belt 18 runwise and replaces the latter in the region of the switching mechanism 10. In this arrangement a first deflection roller 32 of the first rider belt 30 is secured to the base frame 12, whereas a further deflection roller 34 is secured to the pivotal element 14. The arrangement is so selected that the overlapping stream is pressed in each position of the pivotal element 14 between the first rider belt 30 and the second press belt 20. A contact pressure roller 36 is provided on the pivotal element 14 in order to additionally press the first rider belt 30 in the direction of the second press belt 20.

A tensioning roller 38 is provided for the tensioning of the first rider belt 30 and is disposed between the first deflection roller 32 and the further deflection roller 34 and is provided at the end of a compensation element in the form of a pivotal arm 39 which is so prestressed by a (non-illustrated) spring that the first rider belt 30 is always tensioned.

The second rider belt 40 follows the first rider belt 30, but partly overlaps with the first rider 30. The second rider belt 40 is followed by a third rider belt 50, with the rider belt 40 and 50 also overlapping. The second rider belt is for this purpose guided around two deflection rollers 42 (see FIG. 1) and 44 (see FIG. 2) with a tensioning roller 46 being provided between these two deflection rollers. Both deflection rollers 42, 44 and also the tensioning roller 46 are secured to the pivotal element 14.

The third rider belt 50 which follows the second rider belt in a straight line and extends the latter in the conveying direction is guided around a deflection roller 52 and also around a deflection roller 54 which are both secured to the pivotal element 14. A tensioning roller 56 is disposed between the two deflection rollers 52 and 54 and likewise secured to the pivotal element 14. The axes of the deflection rollers 44 and 52 extend approximately coaxially.

Figure 2:
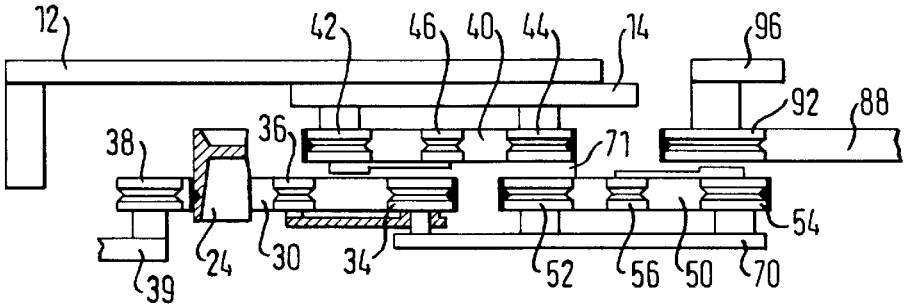
FIG. 2 a sectional view in accordance with the line II—II of FIG. 1.

As FIG. 2 shows, the further deflection roller 34, the tensioning roller 56 and the deflection rollers 52 and 54 are secured to an auxiliary plate 70 which is connected via an installation block 71 to the pivotal element 14. The auxiliary plate 70 thus forms a unit with the pivotal element 14.

Figure 3:
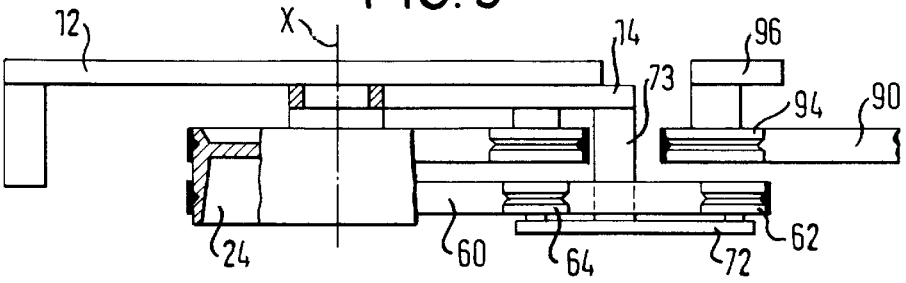
FIG. 3 a sectional view in accordance with the line III—III of FIG. 1.

At the same time it can be seen in FIGS. 2 and 3 that the first rider belt 30, the second rider belt 40 and the third rider belt 50 are respectively arranged mutually overlapping, with the rider belts 30, 50 and 60 being located in a first plane and the rider belt 40 and also the second press belt 20 being disposed in a second plane lying alongside the first plane.

The fourth rider belt 60 disposed in FIG. 1 above the product stream wraps around the stationary deflection roller 24 and is subsequently guided around a deflection roller 62 which is secured to the pivotal element 14. In this arrangement the attachment takes place via a further auxiliary plate 72 which is connected via an installation block 73 to the pivotal element 14.

A contact pressure roller 64 is provided within the fourth rider belt 60 between the stationary deflection roller 24 and the deflection roller 62 and is disposed, when seen in the conveying direction, at the same level or position as the deflection rollers 44 and 52. In this arrangement the contact pressure roller 64 is likewise connected via the auxiliary plate 72 to the pivotal element 14.

The departing pressing belt pair B is provided at the output of the switching mechanism 10 and consists of a first press belt 88 and a second press belt 90. In this arrangement the first press belt 88 wraps around a deflection roller 92 and the second press belt 90 wraps around a deflection roller 94 which are each secured to the base frame 96 of the departing pressing belt pair B and form the start of the departing pressing belt pair B. Further deflection rollers 97 and 98 serve for the guidance of the respective returning run.

On passing through the switching mechanism 10 in the position shown in FIG. 1, the overlapping formation, i.e. the product stream, is first guided between the respective inner runs of the two press belts 18 and 20. After the first press belt 18 has been deflected by the deflection roller 22, the first rider belt 30 takes over the pressing function, and indeed up to and into the region of the deflection roller 42 of the second rider belt 40 which takes over the pressing function at this point. In the region of the second rider belt 40 the product stream is guided between the rider belt 40 and the inner run of the second press belt 20. Thereafter, the product transport is taken over by a pressure between the third rider belt 50 and the fourth rider belt 60, so that the product stream can be transferred to the departing pressing belt pair B.

As has already been mentioned, not just one departing pressing belt pair B is provided in the switching mechanism shown in FIGS. 1 to 3, but rather at least one further departing pressing belt pair is provided, which can be guided and formed designwise in the same manner as the illustrated departing pressing belt pair B. This further, non-illustrated, pressing belt pair could, for example, be arranged so that it effectively extends the arriving pressing belt pair A in a straight line. For this purpose, the input side deflection rollers of the further departing pressing belt pair must have the same spacing from the axis of rotation X as the input side deflection rollers 92, 94 of the pressing belt pair B. In order to be able to switch over between the two departing pressing belt pairs, it is only necessary to actuate the positioning cylinder 16 which pivots the pivotal element 14 and all the parts secured thereon. With such a pivotal movement of the pivotal element 14, the contact pressure roller 36 and the deflection roller 34 of the first rider belt 30, the deflection rollers 42 and 44 and also the tensioning roller 46 of the second rider belt 40, the deflection rollers 52 and 54 and also the tensioning roller 56 of the third rider belt 50, the deflection roller 62 and the contact pressure roller 64 of the fourth rider belt 60 and also the deflection roller 26 of the second press belt 20 are thus pivoted. In this way the product stream also remains pressed in the pivoted state between at least two press belts in each case.

Furthermore, the switching mechanism 10 has a product thickness adaptation which is formed in that the rider belts 30, 40 and 50 are springloaded in a direction substantially transverse to the product conveying direction and adjustable to a certain degree. Specifically, the deflection rollers 22, 32, 36, 42, 52 and 54 of the rider belts are adjustable transverse to the conveying direction, whereas the deflection rollers 26, 62 and 64 are not. Moreover, the deflection rollers 22 and 92 of the press belts are adjustable transversely to the conveying direction, whereas the deflection roller 94 is not. The switching mechanism 10 thus has a "fixed" side and a side which can be adjusted to the thickness of the overlapping formation.

Figure 4:
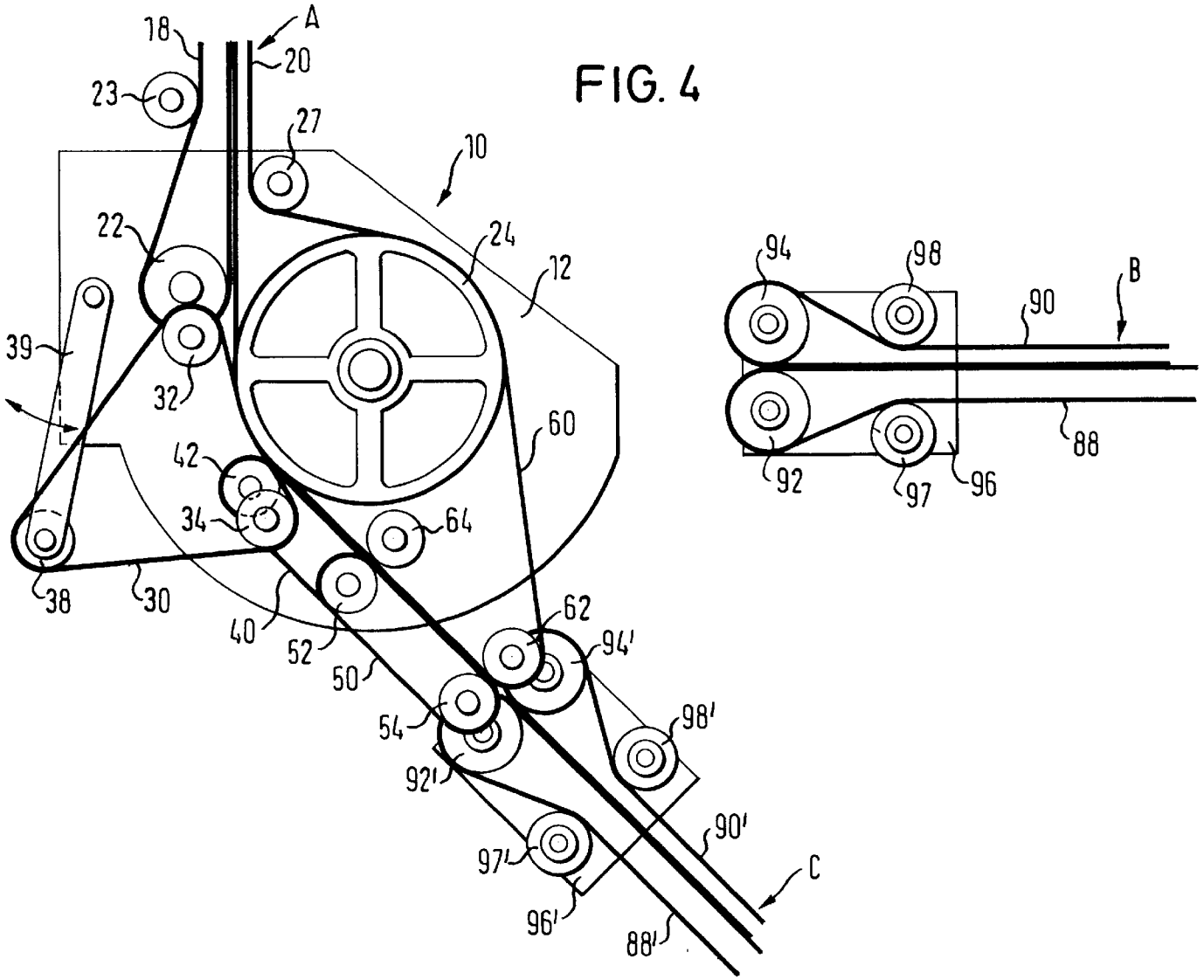
FIG. 4 a side view of a conveying system with a switching mechanism in accordance with a further embodiment.

FIG. 4 shows a further embodiment of a switching mechanism 10 which largely corresponds to the embodiment of FIGS. 1 and 3, but in which a further departing pressing belt pair C is shown. For the sake of simplified representation, some components, for example the pivotal element 14 and also the fourth rider belt 60 are not shown in FIG. 4.

For the further departing pressing belt pair C a first press belt 88' and a second press belt 90' are provided which operate in the same manner as the press belts of the first departing pressing belt pair B. The arrangement of the deflection rollers 92', 94' and also the deflection rollers 97', 98' and the arrangement of the base frame 96' is also the same as for the first departing pressing belt pair B.

As FIG. 4 shows, the (non-illustrated) pivotal element 14 of the switching mechanism 10 has been pivoted through about 45°, whereby the active length of the first rider belt 30 has been shortened. At the same time, the tensioning lever 39 has been pivoted in order to compensate for the shortening of the first rider belt 30 along the conveying path.

As FIG. 4 furthermore shows, the second press belt 20 of the incoming pressing belt pair A is not guided in this arrangement around a deflection roller 26 with a smaller diameter, but rather this press belt 20 surrounds the stationary deflection roller 24 over an angle of about 270°.

For the switching over of the switching mechanism of the invention when conveying a product stream in an overlapping formation a gap is produced in the overlapping formation, for example by a (non-illustrated) pawl which is arranged in front of the switching mechanism and automatically operatable, so that the pivotal element 14 can be pivoted when the gap is located in the region of the switching mechanism. In this way, an online switching is possible during operation without having to stop the product stream.

REFERENCE NUMERAL LIST

10 switching mechanism
12 base frame
14 pivotal element
16 positioning cylinder
18 first press belt
20 second press belt
22, 23 deflection roller
24 stationary deflection roller
26, 27 deflection roller
30 rider belt
32 first deflection roller
34 further deflection roller
36 contact pressure roller
38 tensioning roller
39 pivotal arm
40 second rider belt
42, 44 deflection roller
47 tensioning roller

47 third rider belt
52, 54 deflection roller
56 tensioning roller
60 fourth rider belt
62 deflection roller
64 contact pressure roller
70 auxiliary plate
71 installation block
72 auxiliary plate
73 installation block
88, 88' first press belt
90, 90' second press belt
92, 92' deflection roller
94, 94' deflection roller
96, 96' base frame
97, 97' deflection roller
98, 98' deflection roller
A incoming pressing belt pair
B departing pressing belt pair
C departing pressing belt pair
X axis of rotation

What is claimed is:

1. A switching mechanism for a conveying system for the conveying of a product stream, comprising products arranged in an overlapping formation, by means of a pair of pressing belts, the switching mechanism comprising:

a first pair of arriving pressing belts, and at least two separate pairs of departing pressing belts, said arriving and departing pressing belts having no direct interconnections to each other for conveying of the product stream;

a stationary base frame and a movable pivotal element for the setting of different distribution positions; and a stationary deflection roller for guiding a deflected product stream;

a first rider belt which replaces one pressing belt in a region of the switching mechanism said rider belt being guided around the stationary deflection roller;

a first deflection roller of the first rider belt secured to the base frame and a second deflection roller of the first rider belt secured to the pivotal element.

2. The switching mechanism in accordance with claim 1, wherein the pivotal element is pivotal through about 90°.

3. The switching mechanism of claim 1 including at least one other rider belt including associated deflection rollers at least one of which is secured to the pivotal element.

4. The switching mechanism of claim 1 including a compensation element and a tensioning roller mounted thereto, the compensation element being for the first rider belt and prestressed for movement with the pivotal element upon pivoting thereof.

5. The switching mechanism of claim 1 wherein the belts define a path of movement for the product stream and the other one of the first pair of arriving pressing belts extends about the stationary deflection roller, the stationary deflection roller having a predetermined large radius so that there is a minimum of curvature in the path of the product stream thereabout.

6. The switching mechanism of claim 5 including a third deflection roller secured to the pivotal element downstream of the stationary deflection roller and having a smaller radius than that of the stationary deflection roller, the other pressing belt being guided about the third deflection roller.

7. The switching mechanism of claim 1 including a second rider belt that is guided around the stationary deflection roller, and a third deflection roller secured to the pivotal element and having the second rider belt guided thereabout.

8. The switching mechanism of claim 1 including second and third rider belts with the first and second rider belts being on one side of the product stream and the third rider belt and stationary deflection roller being on the other side of the product stream, the second and third rider belts being adjustable to accommodate for varying product thicknesses.

9. The switching mechanism of claim 1 wherein the pivotal element includes a pivot axis and the stationary deflection roller includes an axis of rotation that extends coaxially with the pivot axis.

10. A conveyor system for conveying a product stream of products arranged in an overlapping formation, the conveyor system comprising:

an arriving pressing belt pair;

at least two departing pressing belt pairs; and a switching mechanism including at least one rider belt in overlapping relation to one of the arriving pressing belt pairs and another rider belt shiftable to be in overlapping relation with either of the at least two departing pressing belt pairs, the switching mechanism being disposed between the arriving pressing belt pair and both of the departing pressing belt pairs so that the arriving belt pair and both of the departing belt pairs do not overlap each other and by which the product stream can be selectively directed to one of the departing pressing belt pairs.

11. A conveying system that allows a stream of products to be securely transferred between independent conveyors; the conveying system comprising a plurality of conveyors each including conveyor belt pairs that cooperate to convey the product stream therealong, the conveyors including an incoming conveyor and a pair of outgoing conveyors with the belts of the incoming conveyor being in non-overlapping relation to those of the outgoing conveyors;

a plurality of rider belts and associated rollers which cooperate to selectively transfer the product stream from the incoming conveyor to a selected one of the outgoing conveyors;

a switching mechanism for the product stream including a single pivot member to which predetermined ones of the rider belt rollers are mounted with the pivot member being pivotable about a pivot axis to change the orientation of the rider belts for feeding the product stream to one or the other of the outgoing conveyors;

a stationary frame having one of the rider belt rollers rotatably mounted thereto about a turning axis offset from the pivot axis for one of the plurality of rider belts, the predetermined ones of the rider belt rollers including a roller for the one rider belt so that the one rider belt has an adjustable operable length for conveying of the product stream which changes as the switching mechanism pivot member is pivoted, and a compensation element for keeping the one rider belt tensioned despite changes in the operable conveying length thereof.

12. A conveying system that allows a stream of products to be securely transferred between independent conveyors; the conveying system comprising;

a plurality of conveyors each including conveyor belt pairs that cooperate to convey the product stream therealong, the conveyors including an incoming conveyor and a pair of outgoing conveyors with the belts of the incoming conveyor being in non-overlapping relation to those of the outgoing conveyors;

a plurality of rider belts and associated rollers which cooperate to selectively transfer the product stream from the incoming conveyor to a selected one of the outgoing conveyors; and a switching mechanism for the product stream including a single pivot member to which predetermined ones of the rider belt rollers are mounted with the pivot member being pivotable about a pivot axis to change the orientation of the rider belts for feeding the product stream to one or the other of the outgoing conveyors;

wherein the plurality of rider belt rollers includes a roller having a rotary turning axis that is coaxial with the single pivot member axis and having an outer circumference in engagement with one of the rider belts with other ones of the rider belts adjacent to the one engaged rider belt and spaced from the outer circumference and in overlapping relation to each other for conveying the product stream thereabout to one of the outgoing conveyors.

* * * * *